US006893289B2

(12) United States Patent
Shinkawa

(10) Patent No.: US 6,893,289 B2
(45) Date of Patent: May 17, 2005

(54) ANTENNA CORD PLUG STRUCTURE

(75) Inventor: Masaki Shinkawa, Yamato (JP)

(73) Assignee: Harada Industry Co. Ltd., Tokyo (JP)

( * ) Notice: Subject to any disclaimer, the term of this patent is extended or adjusted under 35 U.S.C. 154(b) by 0 days.

(21) Appl. No.: 10/726,478

(22) Filed: Dec. 3, 2003

(65) Prior Publication Data

US 2004/0108128 A1 Jun. 10, 2004

(30) Foreign Application Priority Data

Dec. 4, 2002 (JP) ..... 2002-352696

(51) Int. Cl.[7] ..... H01R 9/05
(52) U.S. Cl. ..... 439/578; 439/470
(58) Field of Search ..... 439/578, 916, 439/582, 456, 457, 459, 460, 470

(56) References Cited

U.S. PATENT DOCUMENTS 4,666,232 A * 5/1987 Shyu ..... 439/578
5,890,926 A * 4/1999 Pauza et al. ..... 439/445
6,123,568 A 9/2000 Bullough et al. ..... 439/445
6,283,790 B1 9/2001 Idehara et al. ..... 439/582

OTHER PUBLICATIONS

European Search Report Application No. 03257630.8–2214, dated Mar. 19, 2004.

* cited by examiner

*Primary Examiner*—Ross Gushi
*Assistant Examiner*—Phuongchi Nguyen
(74) *Attorney, Agent, or Firm*—Ohlandt, Greeley, Ruggiero & Perle, LLP

(57) ABSTRACT

An antenna cord plug structure includes a terminal portion formed on one of end portions of the coaxial cable and connected to the antenna device, the terminal portion comprising a central terminal formed on a distal portion and connected to a central conductor of the coaxial cable, and an external terminal formed to cover a part of the coaxial cable, connected to an external conductor of the coaxial cable, and having a first end and a second end, wherein a central conductor is arranged at the first end of the external terminal via an insulation portion and the coaxial cable is extended from the second end of the external terminal, and a plug body comprising an insertion opening into which the coaxial cable is inserted and an engaging portion engaging and fixing the coaxial cable inserted into the insertion opening in a state of being bent at approximately 90 degrees.

7 Claims, 3 Drawing Sheets

ANTENNA CORD PLUG STRUCTURE

CROSS-REFERENCE TO RELATED APPLICATIONS

This application is based upon and claims the benefit of priority from the prior Japanese Patent Application No. 2002-352696, filed Dec. 4, 2002, the entire contents of which are incorporated herein by reference.

BACKGROUND OF THE INVENTION

1. Field of the Invention

This invention relates to an antenna cord plug structure suitable for an antenna mounted on, for example, a roof of a vehicle.

2. Description of the Related Art

In a mounting structure of a roof antenna which is mounted on a roof of a vehicle, an antenna cord plug is fitted in an antenna base directly from a bottom side of the base and connected thereto, and has so-called an L-shaped structure such that the antenna cord plug is bent at approximately 90 degrees in a space inside the roof. An antenna cord composed of a coaxial cable connected to the plug is connected to a tuner unit inside the vehicle through the space of the roof.

The L-shaped antenna cord plug is bent to reduce a length thereof because the space in the roof is very small. In general, many L-shaped plugs corresponding thereto are available.

In the L-shaped antenna cord plug, however, the cord and a terminal portion are integrally formed by molding resin or configured by a metal connector. For this reason, manufacturing costs of the antenna plug are increased.

BRIEF SUMMARY OF THE INVENTION

An aspect of the object of the present invention provides an antenna cord plug structure which is simple and cheap, and which allows an antenna cord to be connected firmly to a base portion of the antenna.

An antenna cord plug structure connecting a coaxial cable, which connects an antenna device and a transmitter-receiver, with the antenna device, according to an aspect of the present invention is characterized by comprising: a terminal portion formed on one of end portions of the coaxial cable and connected to the antenna device, the terminal portion comprising a central terminal formed on a distal portion and connected to a central conductor of the coaxial cable, and an external terminal formed to cover a part of the coaxial cable, connected to an external conductor of the coaxial cable, and having a first end and a second end, in which a central conductor is arranged at the first end of the external terminal via an insulation portion and the coaxial cable is extended from the second end of the external terminal; and a plug body comprising an insertion opening into which the coaxial cable is inserted and an engaging portion engaging and fixing the coaxial cable inserted into the insertion opening in a state of being bent at approximately 90 degrees.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

An embodiment of the present invention applied to an antenna cord plug connected to a vehicle roof antenna will be described with reference to the drawings.

Figure 1A:
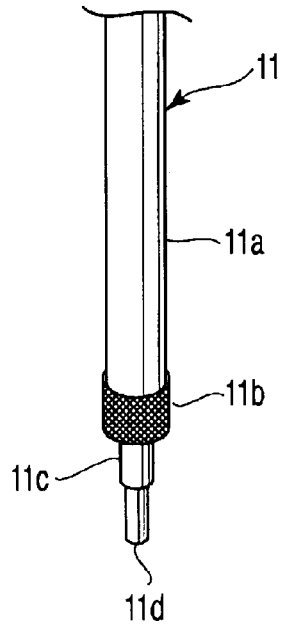
FIGS. 1A and 1B show perspective views illustrating an assembly process of an antenna cord plug according to an embodiment of the present invention.

FIG. 1A shows a structure of a distal portion of a coaxial cable 11 used as an antenna cord, i.e. a structure of the distal portion connected to an antenna base portion (not shown). An external conductor 11*b* composed of woven metal wires is peeled back, at a distal end of an envelope 11*a*. Thus, an insulator 11*c* inside the external conductor 11*b* is exposed and a central conductor 11*d* composed of a single wire is introduced from a top of the insulator 11*c*.

Figure 1B:
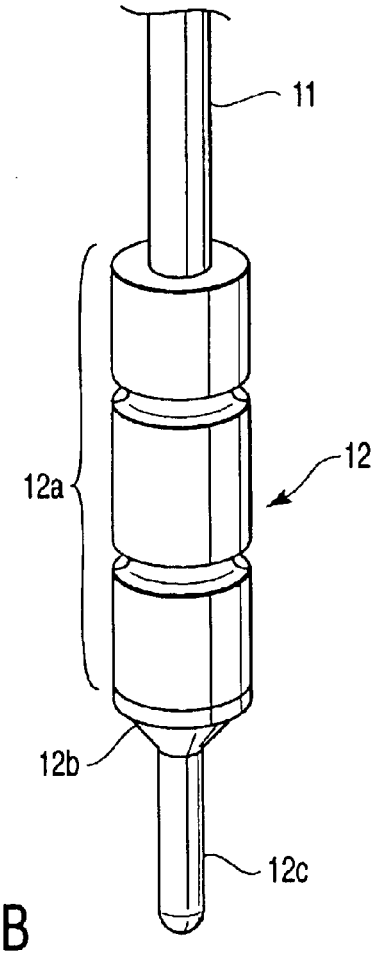

A plug terminal portion 12 is formed on the coaxial cable 11 in configured above, as shown in FIG. 1B. The plug terminal portion 12 has a column-shaped external terminal 12*a* that is constricted at two portions, and a central terminal 12*c* at the top that is formed integrally with the external terminal 12*a* via a conical insulation portion 12*b*.

The external terminal 12*a* is electrically connected to the external conductor 11*b* of the coaxial cable 11 and the central terminal 12*c* is electrically connected to the central conductor 11*d* of the coaxial cable 11.

Figure 2A:
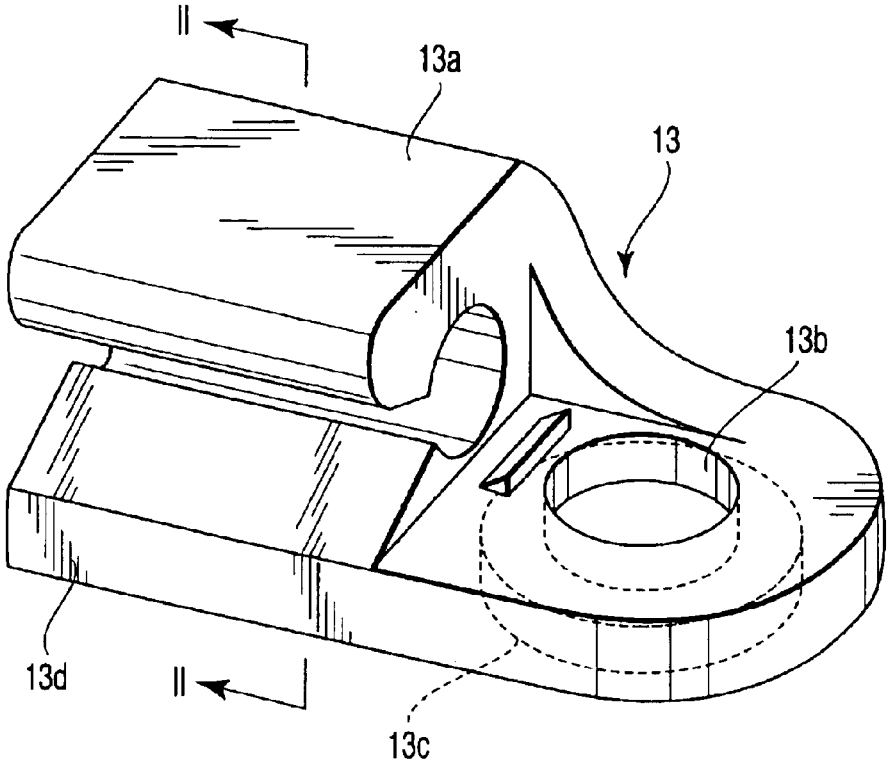
FIGS. 2A and 2B show a structure of a plug body according to the embodiment.

FIG. 2A shows a structure of a plug body 13 fixing the coaxial cable 11 that has the plug terminal portion 12 formed at the top.

The plug body 13 is formed of, for example, ABS resin having the insulation characteristic and elasticity. One end of a plate member 13*d* is shaped in a circle and the other end thereof is shaped in a square plate, and an engaging portion 13*a* of the coaxial cable 11 is formed integrally with the square plate. An insertion opening 13*b* whose diameter is the same as a diameter of the coaxial cable 11 is formed at the center of the circular portion of the plate member 13*d*. A concave terminal fitting portion 13*c* is formed on a lower surface side of the insertion opening 13*b* such that an upper bottom surface of the external terminal 12*a* of the plug terminal portion 12 is fitted in the terminal fitting portion 13*c*.

The engaging portion 13*a* is provided to sandwich and fix the coaxial cable 11 together with the plate member 13*d* along a longitudinal direction of the plate member 13*d*. For this reason, the plate member 13*d* and the engaging portion 13*a* form a slot structure. A recess portion of the slot is formed to have a diameter agreeing with a diameter d1 of the coaxial cable 11 and an opening width d2 of an entry portion of the slot is set to be slightly smaller than the diameter d1 of the coaxial cable 11 as shown in FIG. 2B.

Figure 3A:
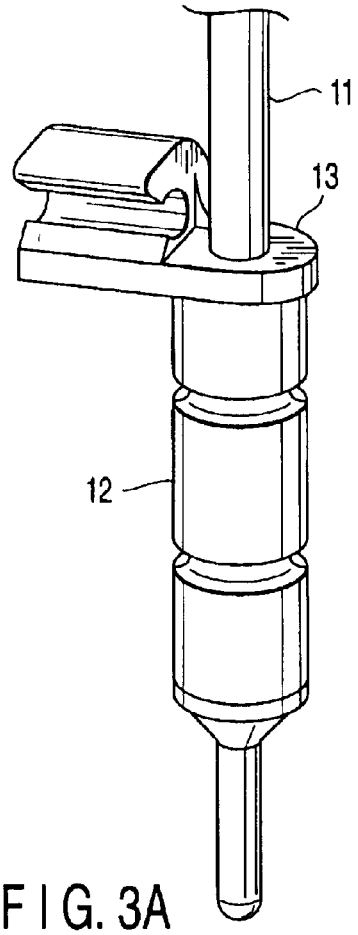
FIGS. 3A to 3C show perspective views illustrating an assembly process of an antenna cord plug according to an embodiment of the present invention.

FIG. 3A shows a state in which the coaxial cable 11 forming the external conductor 12 shown in FIG. 1B is inserted into the insertion opening 13*b* of the plug body 13 and the upper bottom surface of the external terminal 12*a* of the plug terminal portion 12 is fitted in the terminal fitting portion 13*c* formed on the lower surface of the plate member 13*d*.

Figure 3B:
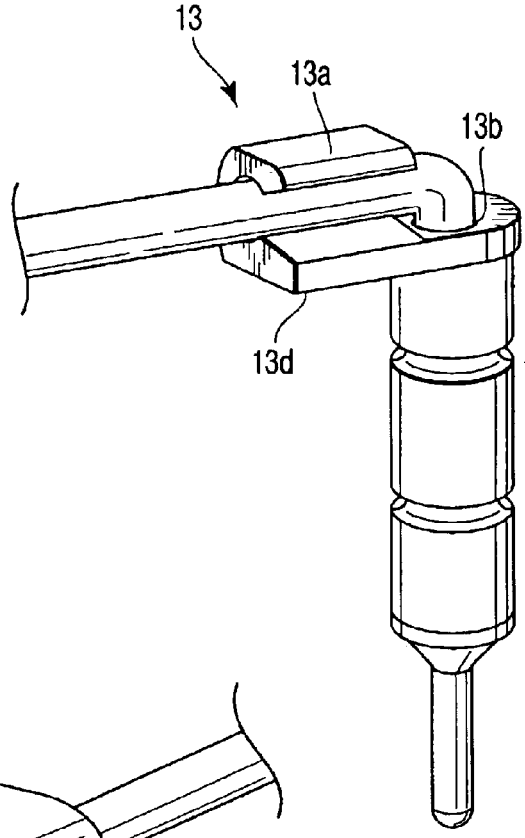

The coaxial cable 11 in the vicinity of the insertion opening 13*b* is bent at approximately 90 degrees and is pressed into the slot between the engaging portion 13*a* and the plate member 13*d* as shown in FIG. 3B, while the coaxial cable 11 is led from the insertion opening 13*b* of the plug body 13.

Figure 2B:
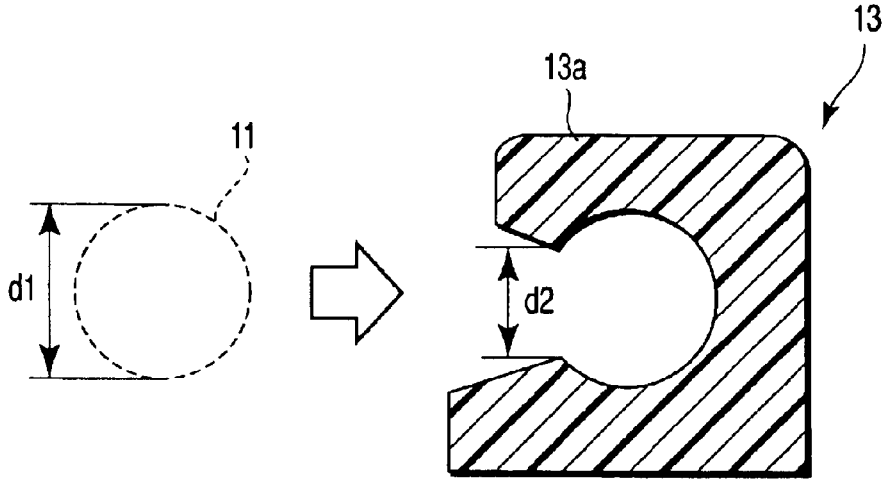

In this case, the diameter d1 of the coaxial cable 11 is slightly greater than the opening width d2 of the entry portion in the slot structure formed by the engaging portion 13*a* and the plate member 13*d* as shown in FIG. 2B. For this reason, a certain amount of resistance is generated against the pressing of the coaxial cable 11. If the coaxial cable 11 is mechanically pressed into the deepest recess portion by, at least, elastic deformation of the plug body 13 and deformation of the coaxial cable 11, the coaxial cable 11 is strongly sandwiched, engaged and fixed.

Figure 3C:
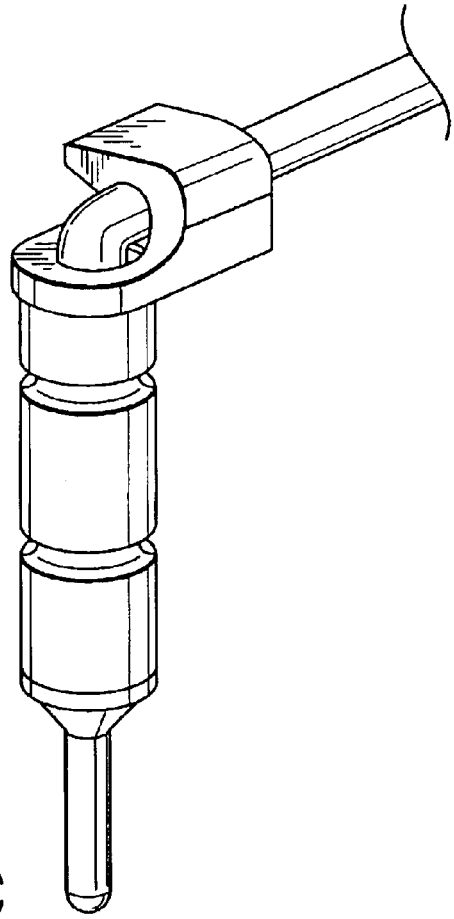

FIG. 3C shows a state of fixing the coaxial cable 11 by the engaging portion 13*a* of the plug body 13 as seen from the other direction. The antenna and the coaxial cable 11 can be connected by holding the plug body 13 and inserting the coaxial cable 11 into a jack of an antenna base (not shown).

In this structure, a troublesome molding process for attaching the coaxial cable 11 to the plug body 13 and the like do not need to be performed. Furthermore, as the plug body 13 is a resin mold product having a simple structure, the assembly is facilitated at very low costs and the antenna cord can be strongly connected to the antenna base portion.

In addition, the terminal fitting portion 13*c* in which the upper bottom surface of the plug terminal portion 12 is fitted is formed on the lower surface side of the insertion opening 13*b* of the plug body 13. Therefore, the plug terminal portion 12 can be strongly attached and fixed to the plug body 13.

Moreover, the plug body 13 is formed of an insulator resin such as ABS resin having elasticity. The engaging portion 13*a* forms the slot structure having a smaller opening width than the diameter of the coaxial cable 11 together with the plate member 13*d*. The coaxial cable 11 is pressed into the engaging portion 13*a* by elastic deformation of he insulator resin, and is sandwiched and fixed. Therefore, the coaxial cable 11 can be strongly attached and fixed to the plug body 13.

In this embodiment, application to the plug for the antenna cord composed of the coaxial cable connected to the vehicle roof antenna has been exemplified. However, if the plug structure is shaped in an L letter to limit the height of the plug, the attachment place and the like are not limited.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An antenna cord plug structure connecting a coaxial cable, which connects an antenna device and a transmitter-receiver, with the antenna device, the antenna cord plug structure comprising:

a terminal portion formed on one of end portions of the coaxial cable and connected to the antenna device, the terminal portion having a central terminal formed on a distal portion and connected to a central conductor of the coaxial cable, and an external terminal formed to cover a part of the coaxial cable, connected to an external conductor of the coaxial cable, and having a first end and a second end, in which a central conductor is arranged at the first end of the external terminal via an insulation portion and the coaxial cable is extended from the second end of the external terminal; and a plug body for fixing the coaxial cable in a bent state of about 90 degrees, said plug body having an elongated flat plate with an insertion opening into which the coaxial cable is inserted and an engaging portion that is integrally formed on an opposite end of the elongated flat plate to hold the coaxial cable parallel to the elongated flat plate, wherein the coaxial cable is set normal to the elongated flat plate by being inserted into the insertion opening, is bent between the insertion opening and the engaging portion, and is set parallel to the elongated flat plate by being held with the engaging portion.

2. The antenna cord plug structure according to claim 1, wherein the plug body is formed of an insulating member.

3. The antenna cord plug structure according to claim 1, wherein the plug body is formed of an insulator resin having elasticity, and the engaging portion comprises a slot portion having a smaller width than a diameter of the coaxial cable such that the coaxial cable is pressed into the engaging portion by at least elastic deformation of the insulator resin.

4. The antenna cord plug structure according to claim 1, wherein the elongated flat plate has first and second surfaces, the engaging portion is formed on the first surface, the plug body further comprises a fitting portion formed on the second surface at the outer region of the insertion opening, and the second end of the terminal portion is fitted into the fitting portion when the coaxial cable is fixed with the insertion opening.

5. The antenna cord plug structure according to claim 1, wherein the second end of the external terminal abuts on the insertion opening of the plug body.

6. The antenna cord plug structure according to claim 5, wherein the plug body further comprises a fitting portion formed on an outer region of the insertion opening, in which the second end of the external terminal abutting on the insertion opening of the plug body is fitted.

7. An antenna cord plug structure connecting a coaxial cable, which connects an antenna device and a transmitter-receiver, with the antenna device, the antenna cord plug structure comprising:

a plug body for fixing the coaxial cable in a bent state of about 90 degrees, said plug body having an elongated flat plate with an insertion opening into which the coaxial cable is inserted, end an engaging portion that is integrally formed on an opposite and of the elongated flat plate to hold the coaxial cable parallel to the elongated flat plate, wherein the coaxial cable is set normal to the elongated flat plate by being inserted into the insertion opening, is bent between the insertion opening and the engaging portion, and is set parallel to the elongated flat plate by being held with the engaging portion.

* * * * *